United States Patent [19]

Wagaman et al.

[11] 4,419,155

[45] Dec. 6, 1983

[54] METHOD FOR PREPARING TERNARY MIXTURES OF ETHYLENEDIAMINE DINITRATE, AMMONIUM NITRATE AND POTASSIUM NITRATE

[75] Inventors: Kerry L. Wagaman; Chester F. Clark, both of Waldorf, Md.; Larry D. Henderson, San Jose, Calif.; W. Steven Jones, Indian Head, Md.

[73] Assignee: The United States of America as represented by the Secretary of the Navy, Washington, D.C.

[21] Appl. No.: 491,462

[22] Filed: Apr. 29, 1983

[51] Int. Cl.[3] ..... D03D 23/00

[52] U.S. Cl. ..... 149/109.6; 149/47; 149/62; 149/92; 149/74

[58] Field of Search ..... 149/109.6, 47, 62, 92, 149/74

[56] References Cited

U.S. PATENT DOCUMENTS

| | | | |
|---|---|---|---|
| 4,098,627 | 7/1978 | Tompa et al. | 149/109.6 |
| 4,353,758 | 10/1982 | Akst et al. | 149/109.6 |
| 4,371,408 | 2/1983 | Fillman | 149/47 |
| 4,383,873 | 5/1983 | Wade et al. | 149/45 |

*Primary Examiner*—Stephen J. Lechert, Jr.

[57] ABSTRACT

An explosive ternary nitrate mixture of ethylenediamine dinitrate, ammonium nitrate, and potassium is prepared by mixing together approximately stoichiometric amounts of aqueous nitric acid, ethylenediamine, ammonia, and potassium hydroxide at a temperature of less than about 130° C. The additions can be made simultaneously or sequentially in any order.

19 Claims, No Drawings

METHOD FOR PREPARING TERNARY MIXTURES OF ETHYLENEDIAMINE DINITRATE, AMMONIUM NITRATE AND POTASSIUM NITRATE

BACKGROUND OF THE INVENTION

This invention pertains generally to inorganic synthesis and in particular to synthesis of energetic salt mixtures.

Traditional general-purpose explosives comprise trinitrotoluene (TNT), which has several disadvantages. It is a Class-A explosive, requiring special mixing and handling procedures and storage facilities, all accordingly increasing the cost of use. The preparation of this explosive is through nitrate substitution of toluene by a mixed acid consisting of concentrated nitric acid and sulphuric acid. The cost of concentrated nitric acid is moderately expensive and the excess nitric acid in the product destabilizes the explosive and presents corrosion problems. Trinitrotoluene is not water soluble and bomb disposal cannot be done economically by steam or hot water.

A binary mixture of ethylenediamine dinitrate (EDDN) and ammonium nitrate (AN) is water soluble, thereby having several advantages over trinitrotoluene such as safer storage as a non-explosive water solution and cheaper disposal. However, the binary mixture has a high melting point, has stability problems, and is expensive. These disadvantages arise primarily from the method of preparation. A recent attempt to improve the synthesis is disclosed in U.S. Pat. No. 4,353,758 by Irving B. Akst and Mary M. Stinecipher. By this method ammonium nitrate in a stoichiometric excess is mixed with ethylenediamine to form the binary mixture. Low yields and purification difficulties have kept the cost of the binary mixture high.

Recently potassium nitrate has been added to improve the stability of the mixture. The problems associated with the binary mixture remain and the amount of chloride impurities is increased by the additional chloride impurities found in potassium nitrate (KN). If these impurities are not removed, the explosive has serious corrosion problems, and if the impurities are removed the cost of the explosive increases greatly. The present method of making the ternary mixture is to mix solid ethylenediamine nitrate, ammonium nitrate and potassium nitrate. Ethylenediamine dinitrate is not commercially available in large quantities and is expensive. Industrial grade ammonium nitrate and potassium nitrate are too impure to be used without the additional expense of purification. Dry mixing three explosives to form an explosive mixture requires special procedures and precautions, causing the cost of the process to increase significantly. As a result of these difficulties binary or ternary mixtures of ethylenediamine dinitrate, ammonium nitrate and potassium nitrate are not being used instead of trinitrotoluene as general purpose explosives.

SUMMARY OF THE INVENTION

It is, therefore, an object of this invention to replace trinitrotoluene as the standard general purpose explosive with a ternary mixture of ethylenediamine dinitrate, ammonium nitrate and potassium nitrate.

Another object of this invention is to produce this ternary mixture by a wet, safe, inexpensive and energy-efficient process.

And another object of this invention is to produce this ternary mixture in a high yield and with a high purity with inexpensive and readily-available starting materials.

These and other objects are achieved by neutralizing nitric acid with three readily available, pure and inexpensive bases to form nitrate salts of ethylenediamine, potassium, and ammonia without forming nitrosamines or nitrites.

DETAILED DESCRIPTION OF THE INVENTION

A ternary mixture (EAK) of ethylenediamine dinitrate (EDDN), ammonium nitrate (AN), and potassium nitrate (KN) is formed by three reactions of nitric acid ($HNO_3$) with ammonia ($NH_3$), ethylenediamine (ED), and potassium hydroxide (KOH). The preferred relative amounts of the reactants are the stoichiometric amounts of one mole nitric acid for every mole of ammonium nitrate or potassium nitrate and two moles of nitric acid for each mole ethylenediamine. An excess of ammonia or ethylenediamine is not as serious as an excess of potassium hydroxide or nitric acid due to the ease of removing these two reactants by evaporation. Although the four reactants can be mixed together simultaneously, it is preferred that they are mixed and reacted in sequence. The preferred sequence is based on the volatility of the bases. In both procedures, but especially in the sequential nitration, the neutralization, suprisingly, is proceeding in an oxygen-rich reaction mix without difficulty.

The sequential nitration can be carried out by either initially adding the entire amount of nitric acid, i.e., four moles of nitric acid per three moles of the other three reactants or by adding a portion of nitric acid with each of the reactants.

In the preferred method, ammonia and aqueous nitric acid in a $NH_3$:$HNO_3$ mole ratio of about 1:4, are mixed together, preferably with an inert diluent, in a reactor to form a solution or suspension of ammonium nitrate, nitric acid, water, and inert diluent (if used and different from water). This reaction is exothermic and the reactor may require cooling. The temperature of the reactor can vary from about 40° to 130° C. If the temperature is kept below 40° C., the cost is needlessly increased, the salts come out of solution, and the reaction rate is slowed. Above 130° C., the increased vapor pressure of water and possibly the inert diluent would require considerable and expensive strengthening of the reactor. A temperature in the reactor from 90° to 110° C. is preferred because the reactor does not have to be very strong, the cost of heat removal is slight, and water and diluent removal is facilitated by a temperature above 100° C.

Ethylenediamine is added to the reactor in an ED:$HNO_3$ mole ratio of about 1:3 to form a solution or suspension of ethylenediamine dinitrate, ammonium nitrate, nitric acid, water, and possibly a diluent. This reaction is very exothermic and may also require that the reactor be cooled.

Potassium hydroxide is next added to the reactor in a KOH:$HNO_3$ mole ratio of about 1:1, resulting in a solution or suspension of ethylenediamine dinitrate, ammonium nitrate, potassium nitrate, water, and inert diluent. This reaction is slightly exothermic.

The ternary salt mixture can be separated by any of the commonly used methods, such as solvent extraction, cooling followed by filtration, or evaporation. The preferred separation method is evaporation because the product stream having the reactor is preferably 90° to 110° C. and therefore evaporation can be effected more economically.

A major advantage of this method is that the industrial grade of the starting materials is relatively high in purity. Nitric acid is widely available as aqueous solutions with a concentration from about 60 to 70 weight percent, a purity in excess of 99 percent, and no chloride ions. Other concentrations can be used, but the cost of the process would be increased by the use of a nonstandard material and the removal of additional water.

Ammonia can be added as a gas, liquid, or solution, e.g., aqueous. The preferred form is liquid ammonia which is readily available at a moderate cost and high purity (99.9%). Ethylenediamine is a liquid with a purity of over 98 percent. Often it is available as an aqueous solution of about 85 to about 100 percent concentration. Other solutions of ethylenediamine can be used, but are not preferred because of additional expense. Preferably potassium hydroxide is added as an aqueous solution from 40 to 50 weight percent concentration. Other concentrations can be used; however, no advantage is gained and the cost of the process is increased.

If the process is run with an inert diluent, a wide variety of diluents can be used. A portion of the product stream can be recycled as the inert diluent. Water can also be used. Other possible diluents include xylene, toluene, n-heptane, benzene, octane, perchloroethylene, methanol, ethanol, and dichloroethane.

Another major advantage of the method of this invention is that it can be carried out quickly in a simple inexpensive pipe reactor with low energy requirements. An example of continuous processing of the subject ternary salt mixture (EAK) is as follows. Production is done in a reaction loop in which a large amount of EAK and water are continuously circulated to limit the temperature rise in the system. A 60 weight percent solution of nitric acid in water enters the loop, followed immediately by liquid ammonia. Some of the acid reacts with the ammonia to form AN. Ethylenediamine (98 weight percent solution in water) is then introduced and reacts with more of the nitric acid to form EDDN. The final reactant, a 45 weight percent solution of potassium hydroxide (KOH) in water, is then added. This neutralizes the remaining acid to form KN and water. Temperature rise due to the heat of reaction is partially offset by the sensible heat of the reactants as they are fed into the reaction loop. The remainder of the temperature increase is offset by a cooling-water heat exchanger which reduces the temperature of the EAK/water stream to about 90 C. The reactants and products then enter a post-reaction surge tank which provides residence time to assure reaction completion. Following the surge tank the majority of the stream is recycled and the remainder is taken off for concentration. All water in the system at this point, (approximately 35 weight percent water) enters the process with the raw materials or was produced by reaction of KOH with nitric acid.

Concentration is effected by the stream passing through batch tanks that provide isolation and remixing capabilities in the event the product does not meet specifications. The stream proceeds to an evaporator feed tank and steam preheater before entering a triple effect evaporator. A triple effect evaporator is selected over a single stage evaporator because of improved safety and effectiveness. This method of evaporation is more effective since all possible heat is removed from the steam in the three evaporator stages at the points in which the greatest effect is realized on the EAK stream. In the evaporator the water content of the EAK solution is reduced to 0.5 weight percent. The water vapor is condensed and then enters a water-recovery tank. The 99.5 weight percent solution of EAK is then sent to a wiped film evaporator where water content is reduced to 0.05 weight percent. The EAK is then either flaked by a chiller belt, packaged and shipped, or cast into bombs.

The above drying can be done at the production site immediately following synthesis or it can be done at a different site or at a different time. This choice is possible because EAK can be safely and easily stored and shipped as an aqueous solution. An aqueous solution of up to 70 weight percent concentration is not classified as an explosive but as a flammable liquid.

The subject method can be used to prepare any ternary mixture (EAK) of ethylenediamine dinitrate (EDDN), ammonium nitrate (AN), and potassium nitrate (KN) by simply varying the respective amounts of the three reactant bases. The preferred mixture is approximately the eutectic mixture of 46 percent of EDDN, 46 percent of AN, and 8 percent KN.

The nitrate salt of the subject ternary salt mixture that is the most readily available with the fewest impurities is ammonium nitrate. If ammonium nitrate can be purified to an acceptable level without excessive cost, the ammonia-nitric acid reaction can be eliminated. The availability of this option depends on the possibility of obtaining sufficiently pure ammonium nitrate at a cost much less than its usual cost. One possibility is that the ammonium nitrate is available at a location very near to the EAK production site, thereby saving much on shipping costs. In order to ensure no reaction between ethylenediamine and ammonium nitrate, it is preferred that ammonium nitrate is added after ethylenediamine has been nitrated.

Having described the invention in general, the following examples are given to illustrate the practice of this invention. It is understood that the examples are given as illustration and are not meant to limit the above description or the claims to follow in any manner.

EXAMPLE 1

Into a 300-milliliter flask was added 51.9 grams of 70 percent nitric acid and then 9.8 grams of gaseous ammonia. The temperature rose to 60° C. An additional 44.2 grams of 70 percent aqueous nitric acid and 14.7 grams of ethylenediamine were added, causing the temperature to rise. The flask was water-jacketed; so, the temperature did not rise about 90° C. Another 7.3 grams of 70 percent aqueous nitric acid and 10.1 grams of 45 percent aqueous potassium hydroxide were added. A sample of the solution was taken for analysis by ion-exchange chromatography. The sample comprised 45.6 percent of EDDN, 46.2 percent of AN, and 8.2 percent of KN.

EXAMPLE 2

Into a five-liter flask, 230 grams of ammonium nitrate (AN) and 257 grams of 70 percent nitric acid were introduced and were heated to 60° C. The mixture was added over a ten-minute period to a mixture of 74 grams of ethylenediamine, 22.5 grams of potassium hydroxide, and 2.5 liters of xylene at 75° C. The mixture was agitated with a standard laboratory paddle stirrer and the temperature rose to 103° C. The lower layer was decanted off. The layer was cooled to 98° C. and solids began to form.

The process of this invention produces ternary mixture of ethylenediamine dinitrate, ammonium nitrate, and potassium nitrate with a high degree of purity at an extremely low cost. The starting materials and equipment used in the method are inexpensive. By this method, the ternary nitrate mixture (EAK) is a better general-purpose explosive than trinitrotoluene (TNT).

Obviously many modifications and variations of the present invention are possible in light of the above teachings. It is therefore to be understood that within the scope of the appended claims the invention may be practiced otherwise than as specifically described.

What is claimed as new and desired to be secured by Letters Patent of the United States is:

1. A method for synthesizing a ternary mixture of ethylenediamine dinitrate, ammonium nitrate, and potassium nitrate which comprises admixing, at a temperature from about 40° to about 130° C., approximately stoichiometric amounts of aqueous nitric acid, ammonia, ethylenediamine, and potassium hydroxise, to form said ternary nitrate mixture.

2. The method of claim 1 wherein said temperature is from 90° to 110° C.

3. The method of claim 1 wherein an inert diluent is included.

4. The method of claim 3 wherein said inert diluent is selected from the group consisting of a solution of said ternary nitrate mixture, water, and mixtures thereof.

5. The method of claim 4 wherein aqueous nitric acid has a concentration from about 60 to about 70 weight percent, ethylenediamine is added as an aqueous solution with a concentration from about 90 to about 100 percent, potassium hydroxide is added as an aqueous solution with a concentration from about 40 to about 50 weight percent.

6. The method of claim 5 wherein said temperature is from 90° to 110° C.

7. A method of synthesizing a ternary mixture of ethylenediamine dinitrate, ammonium nitrate, and potassium nitrate which comprises mixing, at a temperature from about 40° to about 130° C., with aqueous nitric acid, in sequence approximately stoichiometric amounts of aqueous nitric acid, ammonia, ethylenediamine, and potassium hydroxide, to form said ternary nitrate mixture.

8. The method of claim 7 wherein said temperature is from 90° to 110° C.

9. The method of claim 7 wherein an inert diluent is included.

10. The method of claim 9 wherein said inert diluent is selected from the group consisting of a solution of said ternary nitrate mixture, water, and mixtures thereof.

11. The method of claim 10 wherein aqueous nitric acid has a concentration from about 60 to about 70 weight percent, ethylenediamine is added as an aqueous solution with a concentration from about 90 to about 100 percent, potassium hydroxide is added as an aqueous solution with a concentration from about 40 to 50 weight percent.

12. The method of claim 11 wherein said temperature is from 90° to 110° C.

13. A method for synthesizing a ternary mixture of ethylenedinitrate, ammonium nitrate, and potassium nitrate which comprises admixing, at a temperature from about 40° to about 130° C., aqueous nitric acid and ammonia in about stoichiometric amounts, admixing thereto aqueous nitric acid and ethylenediamine in about stoichiometric amounts, and admixing thereto aqueous nitric acid and potassium hydroxide in about stoichiometric amounts.

14. The method of claim 13 wherein said temperature is from 90° to 110° C.

15. The method of claim 13 wherein an inert diluent is included.

16. The method of claim 15 wherein said inert diluent is selected from the group consisting of a solution of said ternary nitrate mixture, water, and mixtures thereof.

17. The method of claim 16 wherein aqueous nitric acid has a concentration from about 60 to 70 weight percent, ethylenediamine is added as an aqueous solution with a concentration from about 90 to about 100 percent, potassium hydroxide is added as an aqueous solution with a concentration from about 40 to 40 weight percent.

18. The method of claim 17 wherein said temperature is from 90° to 110° C.

19. A method for synthesizing a ternary mixture of ethylenediamine dinitrate, ammonium nitrate, and potassium nitrate which comprises admixing, at a temperature from about 40° to 130° C., approximately stoichiometric amounts of aqueous nitric, ethylenediamine and potassium hydroxide; and admixing therewith ammonium nitrate.

* * * * *